US007494095B2

(12) United States Patent
Walker et al.

(10) Patent No.: US 7,494,095 B2
(45) Date of Patent: Feb. 24, 2009

(54) GUTTER HANGER

(75) Inventors: Simon Walker, Delta (CA); Frank Fan, Vancouver (CA); Karen Zhu, Vancouver (CA)

(73) Assignee: Peak Innovations Inc., Richmond, British Columbia ( * ) Notice: Subject to any disclaimer, the term of this patent is extended or adjusted under 35 U.S.C. 154(b) by 0 days.

(21) Appl. No.: 11/282,755

(22) Filed: Nov. 21, 2005

(65) Prior Publication Data

US 2006/0156636 A1 Jul. 20, 2006

(30) Foreign Application Priority Data

Jan. 17, 2005 (CA) ..... 2493006

(51) Int. Cl.
*E04D 13/072* (2006.01)

(52) U.S. Cl. ..... 248/48.2; 52/11

(58) Field of Classification Search ..... 52/11, 52/12; 248/48.1, 48.2
See application file for complete search history.

(56) References Cited

U.S. PATENT DOCUMENTS 3,416,760 A * 12/1968 Sauder ..... 248/48.2
3,426,987 A * 2/1969 Leslie ..... 248/48.2
4,294,422 A * 10/1981 Odekirk ..... 248/48.2
5,004,191 A * 4/1991 Corry ..... 248/48.2
5,388,377 A * 2/1995 Faulkner ..... 52/11
6,543,729 B1 * 4/2003 Ylonen ..... 248/48.1
6,726,155 B1 * 4/2004 Zimmerman ..... 248/48.1
2005/0172565 A1 * 8/2005 Riley et al. ..... 52/12

FOREIGN PATENT DOCUMENTS

JP 02161057 A * 6/1990

* cited by examiner

*Primary Examiner*—Robert J Canfield
*Assistant Examiner*—Christine T Cajilig
(74) *Attorney, Agent, or Firm*—Mark Hopkinson

(57) ABSTRACT

A hanger for mounting a gutter to a structure with a fastener. The hanger may include a bracket arm having first and second ends and extend widthwise to the gutter. A raised fastener guide portion may be connected to the first end of the bracket for delivery of the fastener. An outside gutter engagement device connected to the second end of the bracket arm for engaging the outside wall of the gutter and an inside gutter engagement device connected to the fastener guide portion for engaging the inside wall of the gutter and for receiving the fastener to mount the gutter to the structure may also be provided. A support arm may also be provided having first and second ends. The first end may be connected to the raised fastener guide portion and the second end of the support arm may abut the inside wall of the gutter when the hanger is attached to the gutter.

20 Claims, 1 Drawing Sheet

GUTTER HANGER

FIELD OF THE INVENTION

This invention relates to a gutter hanger bracket. More specifically, the bracket includes a hanger and a fastener held in the hanger in proper attitude to be engaged by an installation tool without the need for separately supporting the fastener during attachment to a building.

BACKGROUND OF THE INVENTION

Gutters for building structures and the like are often trough-like structures formed from sheet metal and mounted by various means to the building. The roofs of such buildings are sloped to direct runoff water into a gutter, which is pitched to carry the water away.

A conventional sheet metal gutter is shaped from a thin sheet of aluminum alloy or galvanized steel into an elongated open trough having various cross sections, such as rectangular or semi-circular. One type of commonly used gutter has an inside, or rear, wall which is positioned adjacent the building and extends generally upwardly parallel to the building surface to which it is attached. A gutter of this type has a front wall forming the opposite side of the trough. The upper margin of the front wall has a lip formed by various bends in the sheet metal structure.

Conventional gutters of the type discussed hereinabove are often mounted near the upper margins of a building wall immediately below the eaves drip line to catch water flowing from the building roof. Fasteners of various kinds, including special gutter-fastening screws, are driven into suitable parts of the building structure, including fascia boards, rafter ends, and the like. Roof shingles and the lower margin of a roof often extend out over the gutter to guide water flow directly into the gutter trough. It is often difficult to find sufficient space to drive a fastener into the upper margin of a gutter mounting near the edge of a roof. A fully driven fastener has its head very near the edges of the overhanging shingles.

The prior art is replete with gutter hangers, some of which provide for fastener elements. One of the most common hangers has been the nail and ferrule type in which a ferrule is disposed between the front and rear walls of the gutter, and a nail is driven through the front wall, through the ferrule, through the rear wall and into the frieze board or fascia of the building structure.

Another type of mounting bracket includes a bracing means and an attachment means. An arm extending across the width of a gutter includes a hook at one end for engaging and bracing the lip formed on the upper margin of the gutter front wall. At the other end of the arm is a clip for engaging the upper margin of the gutter rear wall. A nail is driven through the rear clip and the upper margin of the rear wall in order to mount the bracket and gutter to the fascia board of a building. If the fascia board is, for some reason not parallel to the gutter rear wall, the gutter rear wall will not lie against the fascia board. Shims or other means must then be provided.

Still another prior art means for mounting or hanging a conventional gutter includes using a long spike and a long sleeve. The sleeve is horizontally positioned inside the gutter between the upper margins of the front and rear walls. The long spike is driven through the gutter front wall, through the sleeve, through the gutter rear wall, and into the building structure. The gutter walls are not positively engaged by the sleeve and the spike which is frictionally engaged in the building may eventually be worked loose by various water and ice conditions.

Finally, another type of mounting bracket includes a bracing means and a screw held by a guide portion. An arm extends across the width of a gutter includes a hook at one end for engaging and bracing the lip formed on the upper margin of the gutter front wall. At the other end of the arm is a clip for engaging the upper margin of the gutter rear wall. A screw is driven through the rear clip and the upper margin of the rear wall in order to mount the bracket and gutter to the fascia board of a building. Because guide portions of such mounting brackets are generally weakly held to the bracing means, such guide potions are prone to failure making it difficult to maintain and the drive the fastener into place.

There is a continuing need for inexpensive, simple-to-construct, yet sturdy, gutter hangers that can be used with conventional gutters and the like which overcome the deficiencies noted above. Other objects of the invention will be apparent from the description that follows.

SUMMARY OF THE INVENTION

According to one aspect of the present invention there is provided a hanger for mounting a gutter to a structure with a fastener. The hanger may include a bracket arm having first and second ends and extend widthwise to the gutter. A raised fastener guide portion may be connected to the first end of the bracket for delivery of the fastener. An outside gutter engagement device connected to the second end of the bracket arm for engaging the outside wall of the gutter and an inside gutter engagement device connected to the fastener guide portion for engaging the inside wall of the gutter and for receiving the fastener to mount the gutter to the structure may also be provided.

The raised fastener guide portion may include an upright support member extending upwardly from the bracket arm as well as a connecting crosspiece member between the upright member and the inside gutter engagement device. The upright support member has an aperture formed therein for receiving the fastener.

A support arm may also be provided having first and second ends. The first end may be connected to the raised fastener guide portion and the second end of the support arm may abut the inside wall of the gutter when the hanger is attached to the gutter.

The outside gutter engagement device may include a hook for engaging a slot formed in the upper margin of the outside wall of the gutter. The hook may be a C-shaped member having a reversely bent end which engages a correspondingly formed portion in the upper margin of the outside wall of the gutter.

The inside gutter engagement device may include a clip engaging the upper margin of the inside wall of the gutter. The clip may include an upwardly extending portion connected to the crosspiece member and a connected downwardly extending portion which both form a space for receiving the upper margin of the inside wall of the gutter.

The downwardly extending portion may have an aperture formed therein for receiving the fastener. Such an aperture may align with the aperture of the upright support member of the raised fastener guide portion.

The bracket arm, raised fastener guide portion, outside gutter engagement device, inside gutter engagement device and support arm may be integrally formed as a one-piece unit.

The bracket arm may be an elongated member formed from sheet metal stock and may have a raised portion formed along its length. Additionally, bracket arm may taper from the first end to the second end.

The upright support member may include a support wall extending outwardly from the upright support member and around the aperture to support the fastener.

Other aspects of the invention will be appreciated by reference to the detailed description of the preferred embodiment and to the claims that follow.

BRIEF DESCRIPTION OF THE DRAWINGS

The preferred embodiment of the invention will be described by reference to the drawings thereof in which.

DESCRIPTION OF THE PREFERRED EMBODIMENT OF THE INVENTION

Figure 1:
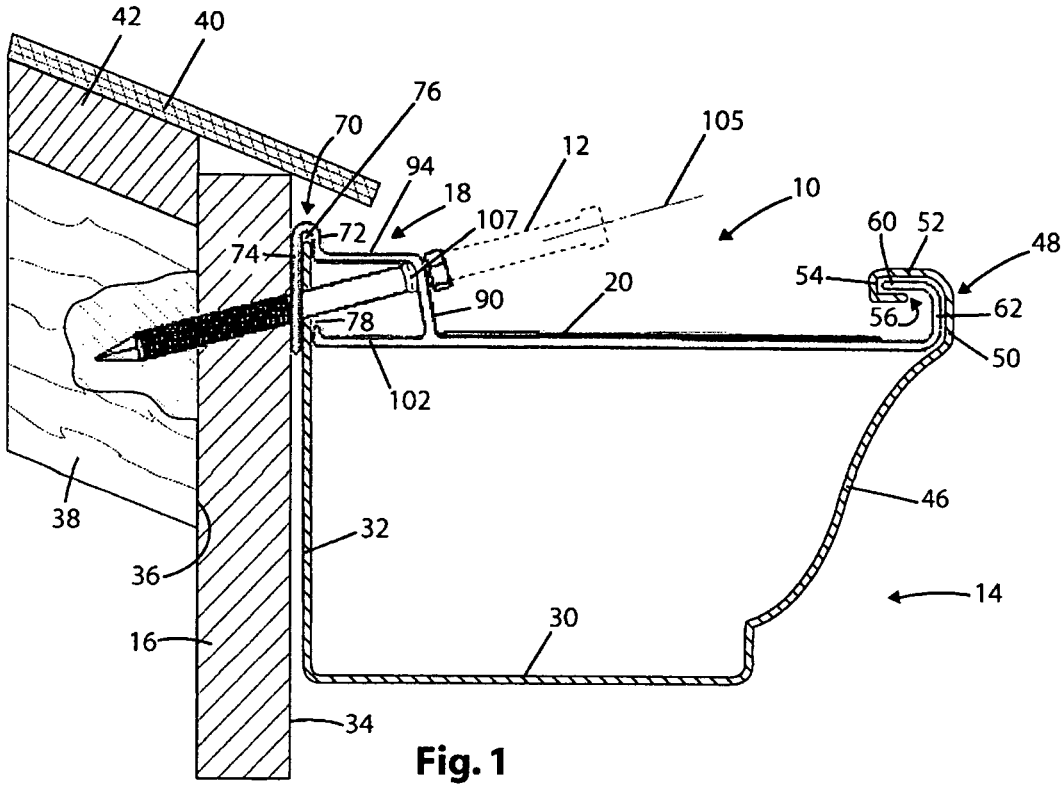
FIG. 1 is a sectional view of a gutter attached to a structure with a gutter hanger bracket according to a preferred embodiment of the invention and a fastener positioned for attachment to a fascia board.

Referring to FIG. 1 of the drawings, a hanger bracket 10 and a fastener 12 provide a means for easily mounting a conventional sheet metal rain gutter 14 to a fascia board 16. When mounted, the bracket 10 vertically supports a section of the gutter 14. The bracket 10 has a raised fastener guide portion 18 which retains and guides the fastener 12, permitting the fastener to be driven at a slight angle into the fascia board 16.

The gutter 14 shown in FIG. 1 is a conventional sheet metal gutter formed, for example, from an aluminum alloy sheet material. Alternative materials, such as galvanized steel sheet stock, are also used to form gutters of this type. The gutter 14 is an elongated trough having a generally rectangular cross section configuration as shown. A bottom wall 30 extends generally horizontally with respect to a fascia board 16. When mounted to the fascia board 16, an upwardly extending rear, or inside, wall 32 of the gutter 14 is positioned to face the outside surface 34 of the fascia board 16.

The fascia board 16 is shown juxtaposed to the vertical end 36 of a roof rafter 38. Roofing elements, such as asphalt shingles 40 are overlappingly laid on inclined roof boards 42. The ends of the shingles 40 in the lowest row extend out over the fascia board 16 so that water flows down the roof and into the gutter 14 trough. The gutter 14 is lengthwise pitched at a slight angle to direct water flow to a downspout. The fascia board 16 and the building structure shown are exemplary.

The fascia board 16 receives the fastener 12, but, for example, the gutter 14 may be fastened directly to the ends 36 of the rafters 38 if required. The front, or outside, wall 46 of the gutter 14 has an upwardly extending reversely curved configuration. While the upper margin of the rear wall 32 is generally planar, the upper margin of the front wall 46 has a lip 48. The lip 48 includes an upwardly extending portion 50 and a connected horizontal portion 52. An inwardly directed channel 54 with an opening 56 is formed at the inside edge of the horizontal portion 52.

Figure 2:
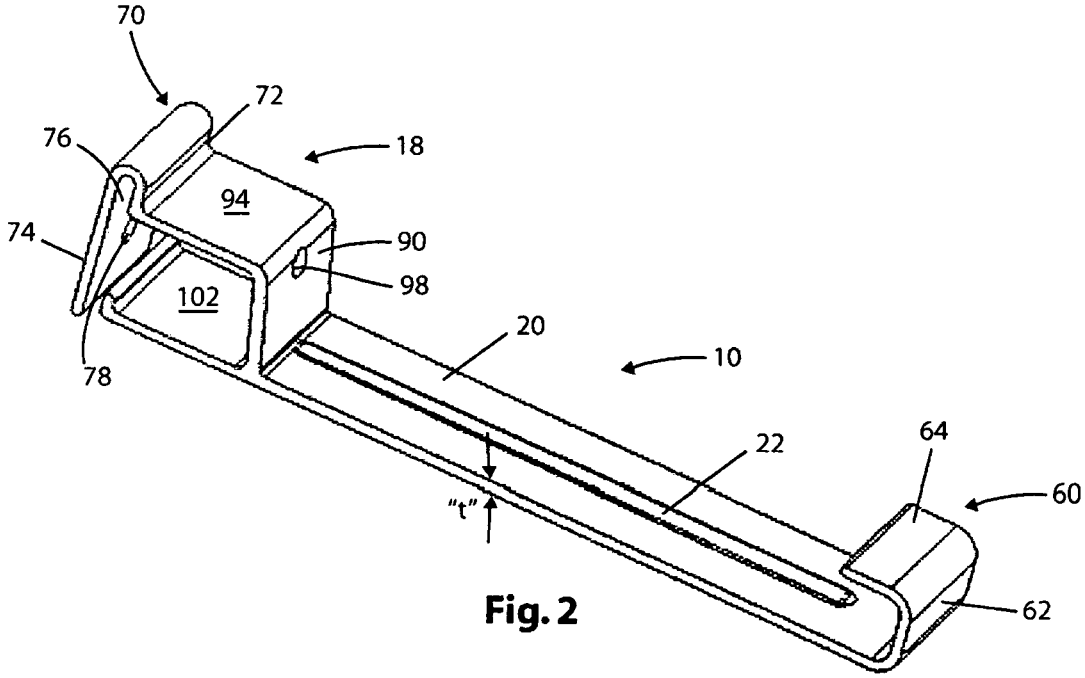
FIG. 2 is a perspective view of the gutter hanger bracket of FIG. 1.

FIG. 2 shows the bracket 10 in a perspective view. The bracket 10 is formed, for example, from aluminum alloy stock of the type commonly used for gutter hangers. The bracket 10 includes a bracket arm 20 which traverses the width of the gutter 14. A raised rib 22 is formed along the length of the bracket arm 20 to provide additional strength to the bracket structure. Additionally, the bracket arm's thickness "t" may taper along its length away from the raised guide portion 18. This provides additional material and strength at the connection between the bracket arm 20 and raised guide portion 18, while concurrently, shaving weight from the overall bracket 10. Other ribbing and dimpling and notching techniques are known in the art and are used to provide additional strength to the bracket arm 20, as required.

A C-shaped hook 60 is formed at the end of the bracket arm 20 and is designed to be received in the opening 56 of the gutter lip 48. The hook 60 includes a short upwardly extending portion 62 and an attached inwardly extending portion 64. The hook 60 serves as a means for engaging the upper margin of the outside wall 46 of the gutter 14, as shown in FIG. 1. The hook 60, which may be formed as an integral part of the bracket arm 20, and the particular configuration of the upper margin of the gutter front wall shown are exemplary and the invention is not limited thereto.

At the other end of the bracket 10 is a clip 70 formed by an upwardly extending portion 72 and a reversely bent, downwardly extending portion 74 which form a space 76 for receiving the upper margin of the inside wall 32 of the gutter 14. An aperture 78 is formed in downwardly extending portion 74 for receiving the fastener 12 when it is driven through the upper margin of the inside wall 32 and into the fascia board 16. The clip 70 may be formed as an integral part of the bracket arm 20.

The raised fastener guide portion 18 of the bracket 10 may also be formed as an integral part of the bracket arm 20. The fastener guide portion 18 has a generally upright front section 90. A crosspiece 94 connects the top of the upright member 90 to the bottom of upwardly extending portion 72. An aperture 98 is formed in the front section 90 of the fastener guide 18.

As best illustrated in FIG. 1, apertures 78 and 98 are positioned along an axis 105 so that the fastener 12 may pass through the guide member 18 and into clip 70. The fastener 12 is thereby held and aligned by the guide member 18. To further support the fastener 12 a support wall 107 extends outwardly from the upright support member 90 and around the aperture 98. The axis of alignment 105 is placed at a sufficient angle with respect to the front portion of arm 22 to provide clearance for an installation tool, such as a screw driver.

A support arm 102 is connected to the raised fastener guide portion 18 and may be integrally formed therewith. The support arm 102 extends from the fastener guide portion 18 and terminates so that it is flush with upwardly extending portion 72. As such, when the bracket 10 is installed, the terminating end of the support arm 102 abuts the inside wall 32 of the gutter 14. By abutting the inside wall 32 of the gutter 14, a closed structure is formed between the raised fastener guide portion 18, the clip 70, the inside wall 32 of the gutter 14, and the support arm 102. The closed structure provides additional support and strength to the raised fastener guide portion 18, thus enabling the bracket 10 to maintain the angular relationship between the fastener 12 and bracket arm 20 when driving the fastener 12 into the fascia 16. Maintaining this angular relationship eases installation of the bracket 10 and the gutter 14 to the fascia 16.

Operation

FIG. 1 shows a bracket 10 assembled to the gutter 14. This is accomplished by holding the bracket in a generally vertical position and engaging the hook 60 in the opening 56 of the gutter front wall lip 48. The bracket 10 is pivoted about the lip 48 so that the clip 70 slides over the upper margin of the rear wall 32. A fastener 12, such as, for example, an aluminum gutter-fastening screw, is then angularly positioned through the guide member 18. When the fastener 12 is finally driven into the fascia board 16, the head of the fastener 12 is positioned next to the guide 18 and away from the fascia board surface 34. This configuration allows an installer to easily mount a gutter 14 because fastener 12 is held in an upright angular position with respect to the guide member 18. Adequate clearance for a screw driver, or other fastener-driving instrument, is provided because the head of a driven fastener is spaced away from the inside wall 32 of the gutter 14. The edges of shingles 40 are not damaged and installation of a gutter is greatly facilitated.

Often, aluminum gutters are continuously formed on an installation site from rolls of flat aluminum stock. As a gutter section is exiting the forming machine, an operator snaps a bracket 10 onto the gutter 14 every few feet, as required. Each bracket 10 has a fastener 12 assembled and positioned in the guide portion 18. No further assembly and/or positioning of the bracket and fastener are required. The gutter with its preassembled brackets and fasteners is merely placed in position and the preassembled fasteners are easily driven into place from the top-center area of the gutter. Gutter installation is thereby made faster and more convenient. The fastener guide structure of the bracket 10 also permits the fastener 12 to function as a cantilever support member for the bracket 10. The fastener 12 provides support to the bracket 10 intermediate the ends of the bracket.

Although the present invention has been described with reference to preferred embodiments, workers skilled in the art will recognize that changes may be made in form and detail without departing from the spirit and scope of the invention.

What is claimed is:

1. A hanger for mounting a gutter to a structure with a fastener, comprising:

a bracket arm having first and second ends, said bracket arm extending widthwise in a first plane and connectable to the gutter;

a raised fastener guide portion connected to said first end of said bracket arm;

outside gutter engagement means connected to said second end of said bracket arm for engaging an outside wall of the gutter;

inside gutter engagement means connected to said raised fastener guide portion for engaging an inside wall of the gutter and for receiving the fastener to mount the gutter to the structure;

said raised fastener guide portion comprising an upright support member integrally formed and extending upwardly from said bracket arm and a substantially planar connecting crosspiece member having an outside end and an inside end, said connecting crosspiece member extending widthwise in a second plane between said outside end and said inside end, said outside end directly connected to said upright support member and said inside end directly connected to said inside gutter engagement means along said second plane, said upright support member having a first aperture formed therein for receiving the fastener;

said inside gutter engagement means comprising a clip engageable to an upper margin of the inside wall of the gutter, said clip comprising an upwardly extending portion directly connected to said crosspiece member, said upwardly extending portion being substantially perpendicular to said crosspiece member, said clip further comprising a downwardly extending portion connected to said upwardly extending portion, wherein said upwardly extending portion and said downwardly extending portion are configured to form a space for receiving the upper margin of the inside wall of the gutter; and a substantially planar support arm extending widthwise in said first plane;

said first plane and said second plane being substantially parallel planes spaced apart by said upright support member;

said support arm having first and second ends;

said first end connected to said upright support member of said raised fastener guide portion;

said second end of said support arm configured to abut the inside wall of the gutter when said hanger is attached to the gutter.

2. The hanger of claim 1 wherein the connections of:

said raised fastener guide portion to said first end of said bracket arm;

said outside gutter engagement means to said second end of said bracket arm; and said first end of said support arm to said upright support member of said raised fastener guide portion, are all direct connections.

3. The hanger of claim 2 wherein said outside gutter engagement means comprises a hook for engaging a slot formed in a top margin of the outside wall of the gutter.

4. The hanger of claim 3 wherein said hook is a C-shaped member having a reversely bent end configured to be engageable to a correspondingly formed portion in the top margin of the outside wall of the gutter.

5. The hanger of claim 2 wherein said downwardly extending portion of said inside gutter engagement means has a second aperture formed therein, said second aperture aligned with said first aperture of said upright support member of said raised fastener guide portion for receiving the fastener.

6. The hanger of claim 2 wherein said bracket arm is an elongated member formed from sheet metal stock and having a raised portion formed along its length.

7. The hanger of claim 2 wherein said bracket arm tapers from said first end to said second end.

8. The hanger of claim 2 wherein said upright support member comprises a support wall extending outwardly from said upright support member and around said first aperture to support the fastener.

9. The hanger of claim 1 wherein said bracket arm, raised fastener guide portion, outside gutter engagement means, inside gutter engagement means and support arm are integrally formed as a one-piece unit.

10. The hanger of claim 1 wherein said bracket arm is an elongated member formed from sheet metal stock and having a raised portion formed along its length.

11. The hanger of claim 1 wherein said bracket arm tapers from said first end to said second end.

12. The hanger of claim 1 wherein said upright support member comprises a support wall extending outwardly from said upright support member and around said first aperture to support the fastener.

13. A one-piece hanger for mounting a gutter to a structure with a fastener, comprising:

a bracket arm having first and second ends, said bracket arm extending widthwise in a first plane and connectable to the gutter;

a raised fastener guide portion integrally formed and extending from said first end of said bracket arm;

outside gutter engagement means integrally formed and extending from said second end of said bracket arm for engaging an outside wall of the gutter;

inside gutter engagement means integrally formed and extending from said raised fastener guide portion for engaging an inside wall of the gutter and for receiving the fastener to mount the gutter to the structure;

said raised fastener guide portion comprising an upright support member integrally formed and extending upwardly from said bracket arm and a substantially planar connecting crosspiece member having an outside end and an inside end, said connecting crosspiece member extending widthwise in a second plane that is substantially parallel to said first plane, said outside end directly connected to said upright support member and said inside end directly connected to said inside gutter engagement means along said second plane, said upright support member having a first aperture formed therein for receiving the fastener;

said inside gutter engagement means comprising a clip engageable to an upper margin of the inside wall of the gutter, said clip comprising an upwardly extending portion directly connected to said crosspiece member, said upwardly extending portion being substantially perpendicular to said crosspiece member, said clip further comprising a downwardly extending portion connected to said upwardly extending portion, wherein said upwardly extending portion and said downwardly extending portion are configured to form a space for receiving the upper margin of the inside wall of the gutter; and a support arm having first and second ends;

said first end extending and integrally formed from said upright support member of said raised fastener guide portion;

said second end of said support arm terminating so that it is flush with the upwardly extending portion such that said second end of said support arm will abut the inside wall of the gutter when said hanger is attached to the gutter; and said support arm configured to not come into contact with said connecting crosspiece member.

14. The hanger of claim 13 wherein said outside gutter engagement means comprises a hook for engaging a slot formed in a top margin of the outside wall of the gutter, said hook being a C-shaped member having a reversely bent end configured to be engageable to a correspondingly formed portion in the top margin of the outside wall of the gutter.

15. The hanger of claim 13 wherein said downwardly extending portion of said inside gutter engagement means has a second aperture formed therein for receiving the fastener.

16. The hanger of claim 15 wherein said first aperture of said upright support member of said raised fastener guide portion aligns with said second aperture of said inside gutter engagement means.

17. The hanger of claim 13 wherein said bracket arm is an elongated member formed from sheet metal stock and having a raised portion formed along its length.

18. The hanger of claim 13 wherein said bracket arm tapers from said first end to said second end.

19. The hanger of claim 13 wherein said upright support member comprises a support wall extending outwardly from said upright support member and around said first aperture to support the fastener.

20. The hanger of claim 13 wherein said support arm is substantially planar and extends widthwise in said first plane, and said first plane and said second plane are substantially parallel planes spaced apart by said upright support member.

* * * * *